US005161906A

United States Patent [19]

Eppler

[11] Patent Number: 5,161,906

[45] Date of Patent: Nov. 10, 1992

[54] WRITING INSTRUMENT

[75] Inventor: Günter Eppler, Leimen, Fed. Rep. of Germany

[73] Assignee: C. Josef Lamy GmbH, Heidelberg, Fed. Rep. of Germany

[21] Appl. No.: 754,044

[22] Filed: Sep. 3, 1991

[30] Foreign Application Priority Data

Sep. 11, 1990 [DE] Fed. Rep. of Germany ..... 4028745

[51] Int. Cl.[5] ..... B43K 9/00; B43K 1/02; B43K 25/00

[52] U.S. Cl. ..... 401/243; 24/11 S; 24/11 R; 40/334; 401/194; 401/250; 401/251; 401/247

[58] Field of Search ..... 24/11 S, 11 F, 11 P, 24/11 R; 401/104, 105, 106, 243, 247, 194, 250, 251; 40/334

[56] References Cited

U.S. PATENT DOCUMENTS

| | | | |
|---|---|---|---|
| 1,720,471 | 7/1929 | Fritsch | 24/11 S |
| 2,533,082 | 12/1950 | Baker et al. | 401/247 |
| 2,537,793 | 1/1951 | Seibert | 24/11 P |
| 2,811,945 | 11/1957 | Keller | 401/104 |
| 2,939,426 | 6/1960 | Rodenhauser et al. | 401/247 |
| 3,101,075 | 8/1963 | Johmann | 120/42.03 |
| 4,643,605 | 2/1986 | Iwasaki | 401/247 X |
| 4,790,678 | 12/1988 | Araki | 401/106 X |

FOREIGN PATENT DOCUMENTS

| | | | |
|---|---|---|---|
| 204920 | 8/1959 | Austria . | |
| 6911385 | 3/1969 | Fed. Rep. of Germany . | |
| 3046093 | 7/1982 | Fed. Rep. of Germany | 401/106 |
| 3806221 | 8/1989 | Fed. Rep. of Germany . | |
| 977290 | 3/1951 | France | 24/11 P |
| 1071637 | 9/1954 | France | 24/11 P |
| 1086929 | 2/1955 | France . | |
| 2413224 | 7/1979 | France . | |
| WO85/03038 | 7/1985 | PCT Int'l Appl. . | |

*Primary Examiner*—Steven A. Bratlie
*Attorney, Agent, or Firm*—Foley & Lardner

[57] ABSTRACT

A writing instrument including a top part (4) which has a movable clip (20) arranged therein in a reliably functioning and stable manner so that the clip can be operated securely. The top part (4) contains a function section in the form of an inner cap (8) which includes a guiding portion (38) along which the clip (20) slides, and the function section is enveloped by a permanently attached outer cap (6).

18 Claims, 4 Drawing Sheets

WRITING INSTRUMENT

BACKGROUND OF THE INVENTION

This invention relates to a writing instrument having a top part which includes a movable clip and a guide portion for guiding the movement of the clip.

French Patent 1,086,929 discloses a writing instrument of this type in the form of a fountain pen containing a barrel with a nib, a reservoir, etc. This writing instrument contains a top part in the form of a removable cap. The cap has a recess at its upper end for a retractable clip. The clip is supported by a spring in the interior of he cap and is pivotally mounted so that the margin of a pocket of an article of clothing, for example, can be gripped in the customary manner between the bottom end of the clip and the outer surface of the cap. For this purpose the clip is rocked at its upper end so that the lower end moves out of the cap. This operation is difficult and very easily leads the user to neglect using the clip and to keep the writing instrument disadvantageously loose in the pocket of an article of clothing. In addition there is a danger that, in grasping the bottom end of the clip, excessive pressure may be applied to the clip and cap due to the comparatively great leverage, so that damage may occur, particularly after a long period of use.

The cap of a fountain pen frequently includes an annular gasket, a cap latch and a cap seat, so the cap can be pushed onto the pen to protect it or attached to the end of the barrel for safekeeping.

U.S. Pat. No. 3,101,075 discloses a writing instrument in the form of an automatic writing cartridge in a first embodiment and of a fountain pen in a second embodiment. The writing cartridge is arranged for axial movement in a barrel, so as to be able to be brought on the one hand into a writing position and on the other hand to an idle position within the barrel. To actuate the writing cartridge a push button is disposed in the top part. The clip is connected to this push button. The top part contains special guiding means for the push button and the clip, which are acted upon by a spring in the same manner as a push button feeder. The guiding means contain a groove extending transversely of the longitudinal axis of the writing instrument, and a pin on which the clip and the push button are pivoted. The clip can also rock laterally and/or move transversely and there is no precise mounting and guidance of the clip. At the end of the writing instrument an additional cap is provided with a slot to facilitate the transverse movement of the push button. Dirt can easily enter through this comparatively large slot into the interior of the barrel and thus interfere with its operation.

Austrian Patent 204,920 discloses a writing instrument in the form of a fountain pen with a replaceable nib. An ink duct is fastened in a longitudinal bore in a nib-holder. The ink duct has a shaft with a smaller diameter than the longitudinal bore in the nib-holder. The fountain pen contains a longitudinally slotted cylindrical shaft which can be inserted into an annular space between the outside diameter of the ink duct shaft and the inside diameter of the nib-holder. This is intended to enable the nib to be changed in a quick and simple manner without special knowledge and particularly by school children. To secure the nib a guide extending into the slot is provided which engages the slot when the nib is inserted. The nib cannot be secured with the needed reliability in this manner, and there is a danger that the nib may accidentally come loose and the ink leak out. The annular space requires a relatively large design length, so that both the space available for a reservoir and the stability in the area of the ink feeder are reduced.

German Utility Model No. DE-G 69 11 385 discloses a device for fastening a clip on the cap of a fountain pen. On the cap end is a snap-on end piece with a rod extending into the interior of the cap. The shaft of the rod passes through a ring on the end of the clip, thereby fastening the clip to the cap. A simple fastening for the clip is thus created, yet it is impossible for the clip to move, much less retract into the cap. After the end piece is inserted and snapped into the cap, it is no longer readily possible to release the end piece.

SUMMARY OF THE INVENTION

It is the object of the invention to provide an improved writing instrument of the kind described above in which important components of the top part will be stable and reliable in operation and well protected against external influences.

Another object of the invention is to provide a fountain pen with a cap which is configured as a stably constructed cap in which the cap closure, the gasket for the pen and the clip operating elements are functionally enclosed within the cap.

A further object of the invention is to provide a writing instrument cap with a clip which can be reliably retracted so that it will not interfere with writing.

It is also an object of the invention to provide an automatic writing cartridge with a push button feed mechanism or rotary feed mechanism including a clip mounting which is functionally encased within a cap.

An additional object of the invention is to provide a writing instrument with a clip which can be actuated simply by a one-hand motion.

Yet another object of the invention is to provide a writing instrument with a sturdily constructed clip which will have a long useful life and which can perform its pocket gripping function independently of all other functions.

A still further object of the invention is to provide a writing instrument with a cap having a stable design and which assures a reliable base for guiding movement of the clip.

Additionally, it is an object of the invention to provide a fountain pen with an improved nib design which facilitates easy installation and exchange of nibs on the ink feeder.

Another object of the invention is to provide a writing instrument which can be reliably engraved without fear of damage.

These and other objects of the invention are achieved by providing a writing instrument including a top part which contains a movable clip and a guide portion, in which the top part further contains a function section in the form of an inner cap in which the clip is fastened and which carries the guiding portion adjacent which the clip is displaceably mounted, and in which the function section is surrounded by an outer cap which is fixedly attached to the function section.

The writing instrument according to the invention is characterized by a stable and reliably-operating design and assures simple actuation of the clip. The cap contains on the one hand a function section with the clip mount and clip guide, and on the other hand an outer cap constituting a jacket which protects the function section. The function section contains a cavity in which the plate-like upper end of the clip is received. The guide is advantageously disposed in this cavity and mates with similar guides formed in the upper end portion of the clip. By means of the cavity and the guide portions, the mounting and the guidance of the clip in the plane of clip movement as well as transversely of this plane are accomplished in combination. The cavity extends substantially from the upper end of the function section to the side of the function section, so that the end portion of the clip can be grasped and actuated with a finger. If the top part is configured as a cap for a fountain pen, the function section contains, in addition to the clip mount, a gasket, the cap latch and the cap seat, and is furthermore in the form of a preassembled unit. In the case of an automatic writing cartridge, the function section likewise contains the clip mount and, in addition thereto, the parts of the mechanism for feeding the cartridge. The function section can be manufactured in accordance with requirements, in particular of plastic. The outer cap achieves a high level of security and protection against external influences. The outer cap serves outstandingly as a support and protective enclosure, so that even if comparatively great external forces are applied, the function section will not be damaged. The wall strength of the outer cap is made to withstand the anticipated stresses. Although the outer cap may be made of plastic, it is preferable to make it of metal, since good stability combined with light weight can thereby be achieved with a comparatively thin wall thickness.

The clip is displaceably arranged in the cap on guide means which incline downwardly toward the longitudinal axis. The cap has a recess at its upper end in which the upper end of the clip is situated in the rest position. By pushing on the upper end of the clip the user can operate the clip, which moves along the inclined guide means while simultaneously retaining its parallel alignment with the longitudinal axis. The clip has corresponding guide means which engage the aforementioned guide portions of the cap and assure sufficient support and guidance for the clip to withstand high stresses. Advantageously, for ease of assembly, the cap contains an end piece which can be inserted from the side into a recess in the cap and serves to support the clip spring. This end piece is disposed at an angle corresponding to the guide portions, and is to be installed from the side together with the spring and clip in the previously manufactured cap. It is secured by a pin or the like, which in accordance with the invention is installed from the inside and makes it possible to replace the end piece and/or the clip, if desired.

In one preferred embodiment the function or working section is configured as an inner cap, and the outer cap is a metal shell. This metal shell preferably has a counterconical outer surface, i.e., one which expands from the cap's mouth. At the rear end of the cap this metal shell has an indentation for receiving the rear of the clip. The function section desirably is constructed as an inner cap which carries the guides. These guide portions advantageously take the form of ribs or tracks which, when the clip is operated, reliably assure its parallel movement. This indentation is directed toward the interior of the cap and has a substantially spherical shape, so that in particular the tip of a user's thumb can be received in this indentation when the clip is actuated until the clip has been brought to its outwardly extended end position. The inner cap is attached to the metal shell in accordance with the invention by filling an intervening space between the inner cap and the metal shell by injection or foaming of a suitable material, particularly a plastic.

In another preferred embodiment of the invention, when the writing instrument is constructed as a fountain pen, the nib is clamped on the ink feeder and affixed to a retaining rib provided thereon. For this purpose the nib is provided with two arms which encompass the ink feeder except for a small gap between the ends of the arms. Viewed in the direction toward the writing tip, the retaining rib is situated in front of the arms and thus assures the retention of the entire nib. The ink feeder is provided with a recess in the vicinity of the gap between the ends of the arms, and when the nib is installed, a tool is introduced into the gap between the ends of the arms, and the arms are spread slightly apart with this tool. The spread apart arms can then be slipped over the retaining rib without damaging it. To remove the nib a tool is introduced through the gap into the recess in the ink feeder in order to again spread the arms slightly apart and thus release the nib from the ink feeder.

In accordance with a further preferred embodiment the writing instrument is provided with a plate in the form of a plaque on which a name, a monogram, or the like, can be engraved. In accordance with the invention, this plaque is releasably attached to the writing instrument and can be removed from the writing instrument for engraving. This assures that the writing instrument itself will not be damaged during engraving. Also, there is no difficulty in replacing an engraving which, for example, no longer pleases the owner, by inserting a newly engraved plaque into the writing instrument. The plaque is attached in an advantageous manner by releasable interlocking catch elements on the plaque and on the writing instrument. The plaque is fastened in particular to the rear of the writing instrument, whereby on the one hand a reliable fastening is achieved by means of the releasable catch elements, and on the other hand, if necessary, removal of the plaque for engraving is facilitated.

BRIEF DESCRIPTION OF THE DRAWINGS

The invention will be described in further detail below with reference to the accompanying drawings which show an illustrative preferred embodiment in the form of a fountain pen, wherein.

DETAILED DESCRIPTION OF PREFERRED EMBODIMENTS

Figure 1A:
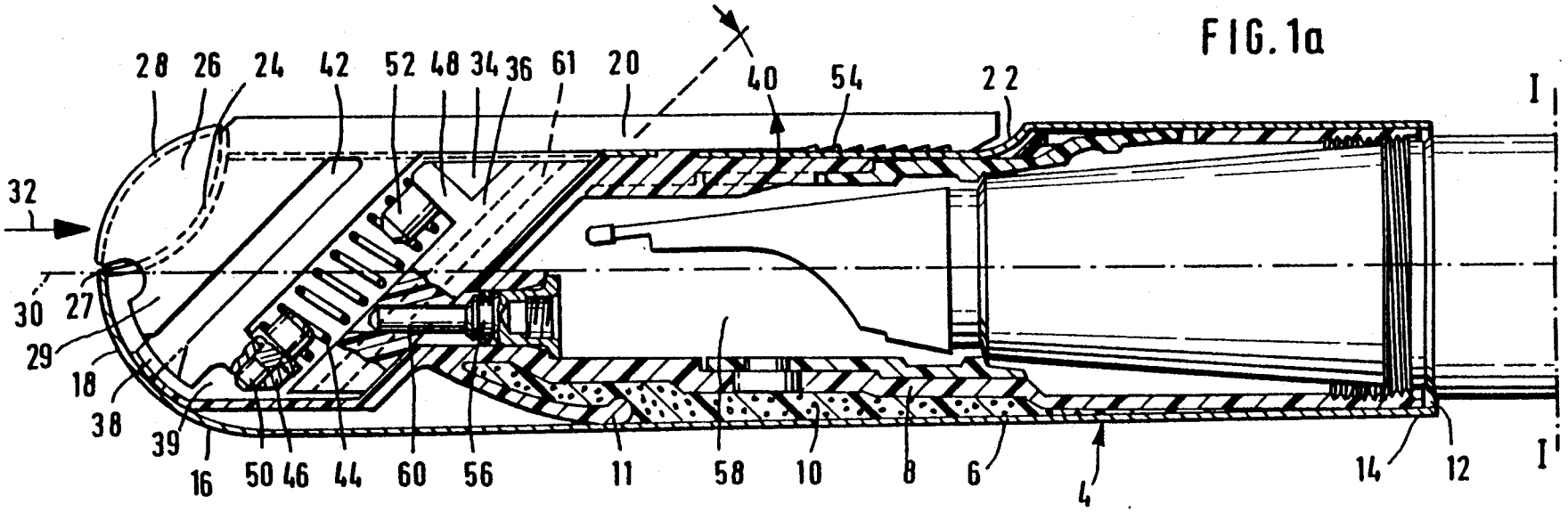
FIGS. 1*a* and 1*b* are sectional views through the writing instrument with the cap in place.
Figure 1B:
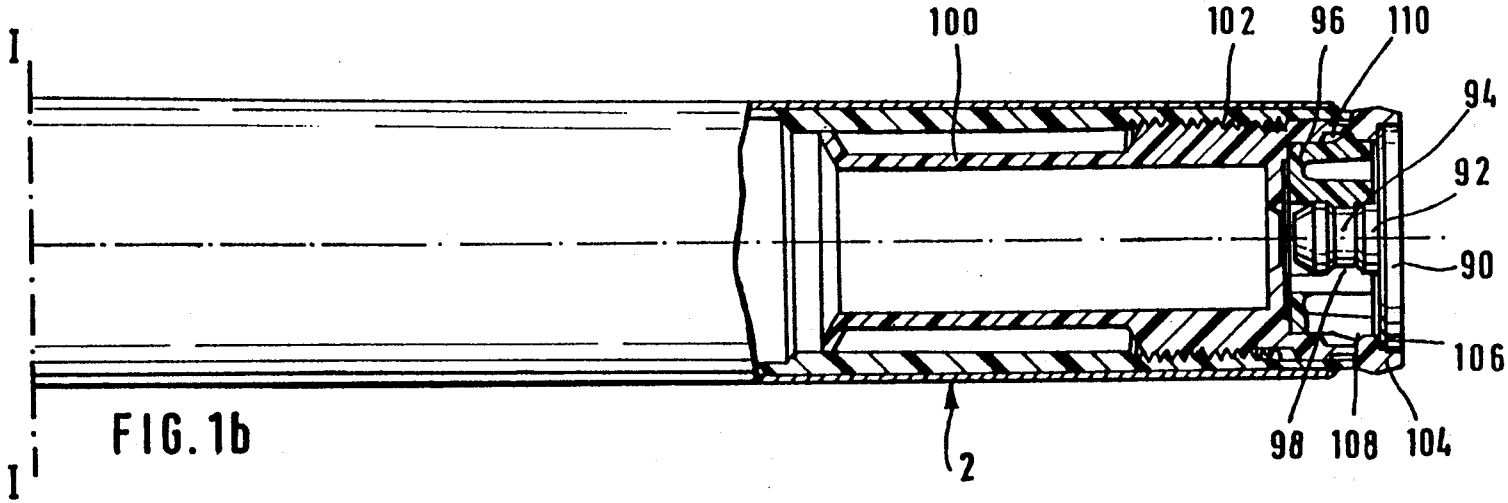

FIGS. 1*a* and 1*b* show a writing instrument 2 in the form of a fountain pen having on its front end a cap 4 which serves as the top part. The section line I marks the dividing line between FIGS. 1*a* and 1*b*, a middle portion of the writing instrument being omitted for the sake of simplicity of illustration, so that writing instrument 2 is not illustrated in its entire length. Cap 4 comprises an outer cap 6 in the form of a metal shell which will be referred to hereinafter simply as the metal shell. Inside the outer cap or metal shell is a working section 8. In the illustrated embodiment, this working section is in the form of an inner cap into which the front end of the fountain pen with the nib can be inserted, if desired. It should be noted that if the writing instrument is a lead pencil, the working section contains the push-button feed mechanism or rotary feed mechanism for the pencil lead instead of an inner cap. In the case of the fountain pen which is shown in the drawings, the working section in the form of an inner cap will be referred to hereinafter simply as the inner cap. The outside dimensions of the inner cap 8 are smaller than the dimensions of the inside surface of the metal shell 6, so that before assembly, an intervening space will exist which can be filled during assembly with a suitable material 10 for bonding the metal shell 6 to the inner cap 8. This may be accomplished in particular by spraying or filling the intervening space with a plastic foam. The inner cap also contains fins or one or more spacers 11 which hold the inner cap 8 in position before it is permanently joined to the metal shell 6. The metal shell 6 has a counterconical external shape. The outside diameter of the cap 4 at its first end 14, which is associated with the cap opening 12, is smaller than at the other end 16 at which the cap terminates in a hemispherical surface 18.

A clip 20 is substantially retracted in a lateral recess 22 in the outer cap or metal shell 6. At its second end 16 the metal shell 6 has an indentation 24 in the area of the hemispherical surface 18 for an outwardly rounded clip end 26. The external contour of the clip end 26 substantially matches hemispherical surface 18 and projects only slightly beyond the upper end 27 of the outer cap or metal shell 6. Furthermore, the clip end 26 is provided with gripping ridges 28 extending transversely of the longitudinal axis. The clip end 26 has a plate-like construction and has two parallel lateral surfaces 29 which lie substantially parallel to the plane of drawing. The clip can be operated by pushing with one finger in the direction of the longitudinal axis 30 indicated by the arrow 32, the finger being able to extend easily into the indentation 24 and come to rest therein when the clip is deployed.

The inner cap 8 has a cavity 34 in which an end piece 36 is inserted from the side. The cavity 34, the end piece 36 and the guide portions 38 are disposed at an acute angle 40 relative to the longitudinal axis 30. This angle is in the range from about 30° to about 60°, preferably from 40° to 50°. The cavity 34 is open toward the clip 20, so that the plate-like clip end 26 can be introduced from the side into the cavity 34. The opening of cavity 34 extends from the side continuously to the upper end 27 of the cap. Also the clip 20 according to the invention extends in the area of the outside surface continuously from the long part of the lateral recess 22 to the upper end 27. The plate-like clip end 26 can therefore be very easily grasped at the grip ridges by one finger to actuate the clip. The plate-like clip end 26 lies with its parallel lateral surfaces 29 against the oppositely disposed, similarly parallel side walls 39 of the cavity 34, preferably with a slight clearance. This will assure, in a very desirable manner, a very stable lateral guidance of the clip 20 in the working section 8. At the same time a large-area support is provided for the plate-like clip end 26 against the lateral walls 39 of the working section 8, so that quite tight clearances can be easily maintained and a secure guidance of the clip 20 is assured.

The two diametrically,,disposed sides 39 furthermore carry two guiding portions. 38, one being situated in front of the plane of drawing and the other in back of the plane of drawing, which mate with corresponding guide grooves 42 in the end 26 of the clip. Inside the inner cap 8 there is furthermore disposed a clip spring 44, which is in the form of a compression spring. Spring 44 is held at one end on a projection 46 of the clip end 26 and at the other on an abutment 48 of the end piece 36 by means of small pins 50 and 52. The end piece 36 is likewise inserted from the side through the above-mentioned opening into the cavity 34. The end piece 36 thus serves to secure and hold the clip 20 in the function or working section 8.

The clip 20 and the end piece 36 can be inserted together with the clip spring 14 into the cap 4 from the side, which here is in the plane of the drawing. The widths of clip 20 and end piece 36, measured perpendicularly to the plane of drawing, are substantially the same, and the width of the recess 32 is chosen accordingly, so as to permit the clip to be inserted and subsequently actuated. If the clip end 26 is pushed in the direction of the arrow 32, a movement takes place along the guiding portions 38, compressing the clip spring 44 until the ends of the pins 50 and 52 meet. The clip 20 maintains its parallel alignment with respect to the longitudinal axis 30, and the margin of the pocket of an article of clothing can be slid into the gap that forms between the recess 22 and the inside face of the clip 20 which bears teeth 54. The necessary clamping pressure is then applied by means of the clip spring 44.

The guide portions 38 and the guide grooves 42 as well as the sides 39 of the cavity 34 in the inner cap 8 provide a stable and functional parallel guidance of the clip 20, and at the same time comparatively large guidance and contact surfaces are present in all positions of the clip, and excessively high surface pressures are reliably avoided. When the clip 20 is actuated, a linear movement takes place corresponding to the above-mentioned angle of inclination 40 while the clip 20 otherwise retains its parallel alignment with respect to the longitudinal axis 30, in accordance with the invention. Therefore, in accordance with the invention, the plate-like clip end 26 and the function section 8 contain guidance and abutment surfaces corresponding to one another, along which the movement of the clip, when it is actuated, takes place in a defined direction. It is important in this case that transverse movements as well as rocking movements are prevented by the guidance in the direction defined by the guide portions 38 and additionally by the sides 39 of the cavity.

The end piece 36 is secured in the cavity 34 of the inner cap 8, preferably by a threaded screw 56. When the clip 20, the end piece 36 and the clip spring 44 are installed in the cavity 34, the threaded screw 56 is screwed with its tip 60 extending into the end piece 36 from the interior 58 of the inner cap 8, as shown in the drawing. If at any time repair should be needed, the components can be removed again in reverse order. The end piece is introduced into the cavity 34 and secured in particular against displacement toward the upper end 27 by means of lateral ridges 61 which are shown in the drawing in broken lines. Preferably, each of the two diametrically disposed sides 39 of the cavity 34 contains a ridge 61 of this kind.

Figure 2:
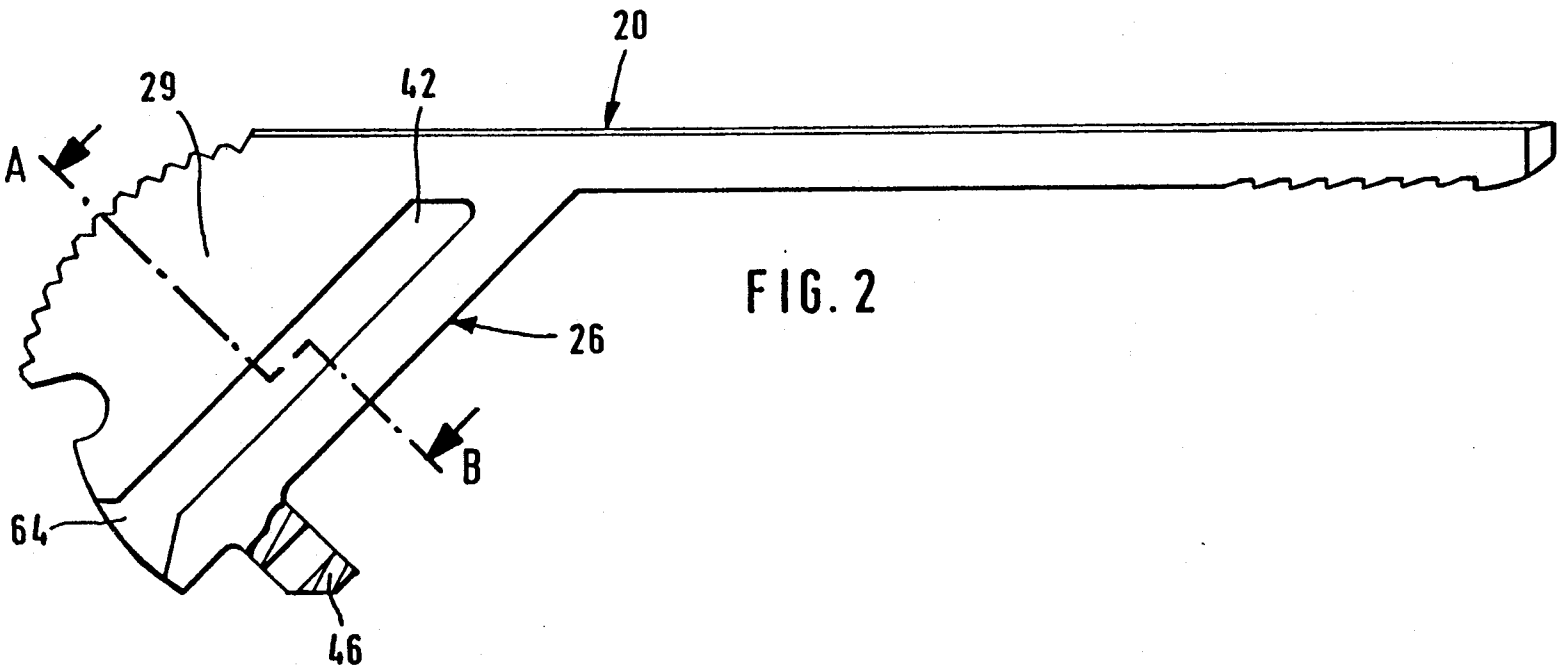
FIG. 2 is an elevational view of the clip.
Figure 3:
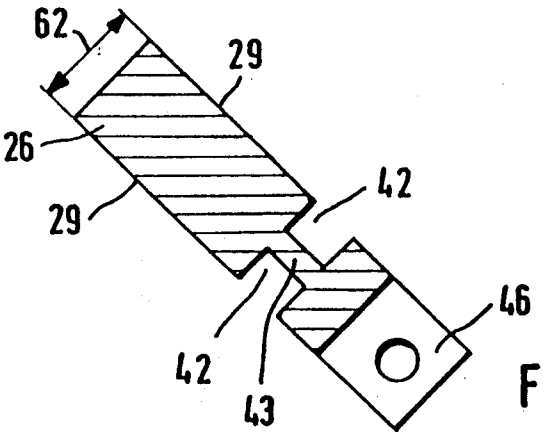
FIG. 3 is a sectional view through the end of the clip taken along section line A–B.

FIG. 2 shows the clip 20 in a side elevation, and FIG. 3 a section through the clip end 26. As can be seen from the drawing, the plate-like clip end 26 adjoins the long part of the clip 20. Due to this special plate-like configuration of the clip end, the clip 20 has a high stability and overall strength. This is in distinct contrast to prior art clips formed of bent members. The clip has substantially the same width 62 over its entire length and is made of solid material, preferably metal. The width 62 is slightly less than the corresponding width of the aforedescribed cavity 34 in the cap so as to permit free movement. The projection or abutment 46 extends away from the plate-like clip end 26 and is made in one piece therewith. As previously explained, the projection 46 serves to block the clip so that, on the one hand, the desired parallel movement can be performed when the clip is actuated, and that, on the other hand, the clip is prevented from being extended an excessive distance out of the lateral recess 22 and so cavity 34, as it can be seen in connection with FIG. 1*a*. For this purpose the end piece 36 is advantageously disposed in the cavity 34. It is also within the scope of the invention to effect such blocking directly by means of the screw 56, whose tip, when the clip is in the retracted position, would in this case be spaced a distance from the projection 46 corresponding to the necessary movement to extend the clip.

The guide grooves 42 provided on both sides of a connecting web can best be seen in FIG. 3. The guide portions 38 of the end piece 26 engage in these grooves 42. These guide grooves 42 contain an open end 64 at the top to facilitate the introduction of the guide portions. During assembly in accordance with the invention, the clip 20 is inserted from the exterior of cap 4 into the cavity 34 through its lateral opening.

Figure 4:
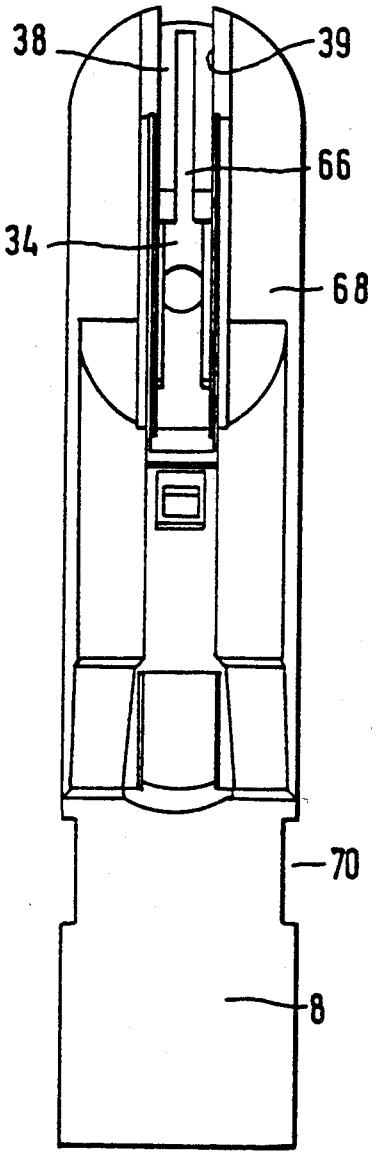
FIG. 4 is a view of the inner cap viewed toward the indentation.

FIG. 4 shows a view of the function or working section configured as the inner cap 8, viewed looking at the cavity 34. Here can be seen the two lateral guiding portions 38, between which there is a gap 66. After insertion of the clip, the connecting web 43 between the two guide grooves 42 on clip end 26 is situated in this gap 66. The inner cap 8 furthermore has a number of indentations 68 and 70 on its exterior. During assembly, after the inner cap 8 has been inserted into the outer metal shell cap or, these indentations 68 and 70 as well as the previously mentioned intervening space between the cap and shell are filled with a suitable plastic, particularly by foaming, thus providing a reliable anchoring in the counterconical metal shell, in a manner similar to an expansion bolt.

Figure 5:
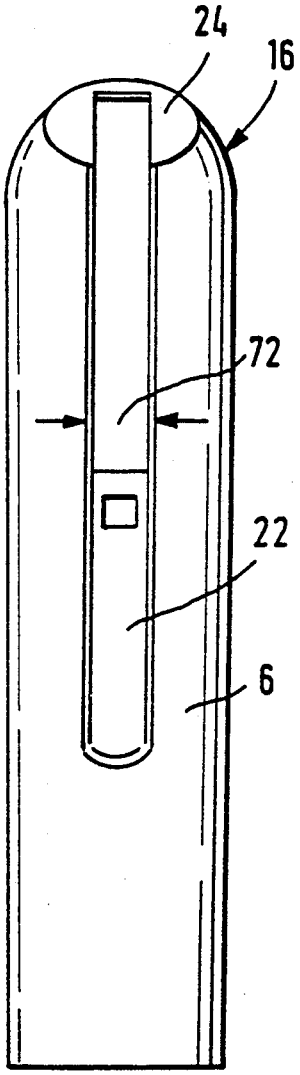
FIG. 5 is a front view of the outer cap.
Figure 6:
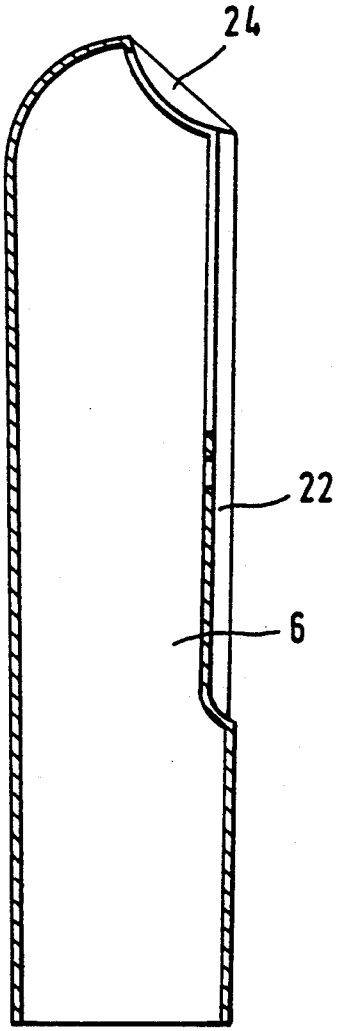
FIG. 6 is an axial section through the outer cap in the same plane as FIG. 1*a;*

In FIGS. 5 and 6 the metal shell 6 is shown in a front elevation and in an axial section, respectively. The lateral recess 22 can be seen as well as the indentation 24 on shell end 16 for the clip end. The width 72 of the recess 22 is slightly greater than that of the clip, so that the clip can be actuated without interference from the metal shell.

Figure 7:
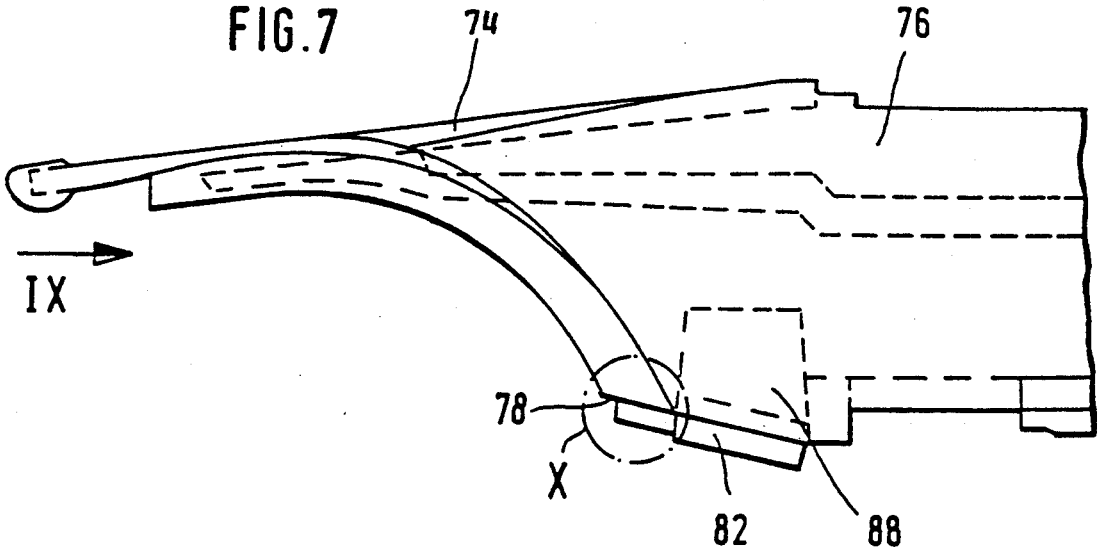
FIG. 7 is a side view of the nib and ink feeder.
Figure 8:
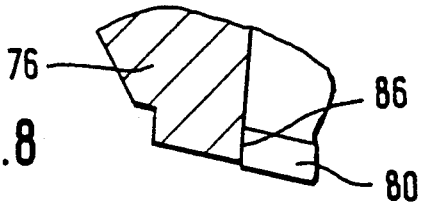
FIG. 8 is an enlarged view of the circled region "X" of FIG. 7.
Figure 9:
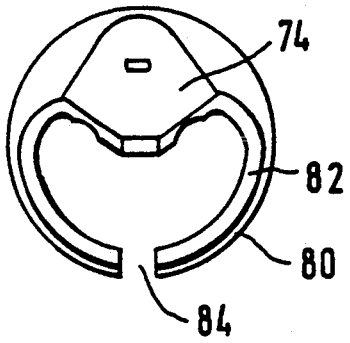
FIG. 9 is an end view of the nib viewed in the direction of arrow IX in FIG. 7.

FIGS. 7 to 9 show an enlarged nib 74, which in accordance with FIG. 1 is arranged on the front end of the writing instrument and can be enclosed by means of the cap 4. Nib 74 is conical and is disposed on the ink feeder 76 which extends out of the barrel of the writing instrument. The ink feeder 76 has at its bottom an abutment 78 against which the spring arms 80 and 82 of nib 74 rest. Between the two arms 80 and 82 there is a gap 84. To install the nib a can be introduced into the gap 84 to force the spring arms 80 and 82 apart. The nib 74 can then be pushed onto the ink feeder 76, causing the arms 80 and 82 to slip over the abutment 78 without touching the abutment, much less damaging it. After removal of the tool, the arms 80 and 82 then grip a shoulder 86 of the abutment 78 therefore assuring a defined locking of the nib 74 in position. The ink feeder 76 has a recess 88 on its bottom for the aforementioned tool. The tool is introduced into this recess 8 both for installing the nib 74 and for removing the nib when desired.

Preferably at the rear end of the writing instrument 2, as shown in there is a plate 90 which is used as a plaque for a personal monogram. The plate is releasably fastened in a reliable manner to the writing instrument by means of a snap fastener mechanism. The plate can easily be removed from the writing instrument, by pulling apart the snap-catch mechanism which attaches the plate to the writing instrument. The plate 90 has a forward pointing stud 92 with an annular groove 94. At the rear end of the writing instrument there is a fastener socket 96 containing inwardly pointing radial ridges 98. These ridges 98 engage the annular groove 94 and thus serve to axially secure the plate 90. The fastener socket 96 is advantageously disposed in an end cap 100 which is screwed by means of a thread 102 into the rear end of the writing instrument 2. The end cap 100 has an annular rim 104 which projects beyond the end of the writing instrument and contains an annular shoulder 106 against which the plate 90 is set. The fastener socket 96 has a fastening means 108 projecting radially outwardly which catches on the inside of the annular rim 104 and is thus locked in a recess 110 in the end cap 100.

The foregoing description and examples have been set forth merely to illustrate the invention and are not intended to be limiting. Since modifications of the described embodiments incorporating the spirit and substance of the invention may occur to persons skilled in the art, the scope of the invention should be construed to include all variations falling within the ambit of the appended claims and equivalents thereof.

What is claimed is:

1. A writing instrument comprising a writing member disposed in a housing wherein said housing includes a top part configured to define a laterally open cavity with axially parallel cavity side walls, said cavity extending from an upper side portion to a top portion of said top part; said top part further being configured to define a clip recess extending axially along a side portion thereof from said cavity toward a bottom portion of said top part;

a movable clip member mounted in said top part comprising an enlarged clip head with axially parallel clip head side walls received in said cavity and an elongated clip portion extending substantially parallel to the axis of said writing instrument, and guide means comprising inter-engaging elongated ribs and grooves arranged on said cavity side walls and on said clip head side walls at an acute angle to the axis of said writing instrument for guiding said movable clip member along an oblique path between a retracted position in which said clip portion is received in said clip recess and an extend position in which said clip portion is spaced away from said top part, whereby said clip member is prevented from pivoting and said clip portion remains at all times substantially parallel to the axis of said writing instrument.

2. A writing instrument according to claim 1, further comprising a resilient member for urging said clip member toward said retracted position.

3. A writing instrument according to claim 1, wherein said top part comprises an inner cap and an outer cap surrounding said inner cap.

4. A writing instrument according to claim 3, wherein said inner cap is secured in said outer cap by filling an intervening space between said inner and outer caps with a plastic or foam material.

5. A writing implement according to claim 4, wherein said outer cap has a substantially counterconical outer contour with a smaller diameter at a first end associated with a cap opening than at second end in which said cavity is formed.

6. A writing instrument according to claim 1, wherein said top part is configured to define an indentation at said top portion thereof surrounding said clip head, and said clip head projects into said indentation, whereby said clip member can be moved to said extended position by a user placing a finger in said indentation and pushing on said clip head.

7. A writing instrument according to claim 6, wherein said clip (20) has gripping grooves on its outer surface in the vicinity of said indentation (24) in the top part (4).

8. A writing instrument according to claim 1, wherein said clip recess is wider than said laterally open cavity.

9. A writing instrument according to claim 1, wherein said guide means are arranged at an angle in the range from about 30° to about 60° with respect to the longitudinal axis of said writing instrument.

10. A writing instrument according to claim 9, wherein said guide means are arranged at an angle in the range from about 40° to about 50° with respect to the longitudinal axis of said writing instrument.

11. A writing instrument according to claim 1, comprising a nib (74) configured with a forward taper and with two arms (80, 82) substantially surrounding an ink feeder (76), said two arms having a gap (84) between the ends of said arms (80, 82).

12. A writing instrument according to claim 11, wherein said ink feeder (76) has on its bottom a retaining abutment (78) having a shoulder (86) against which the arms (80, 82) of said nib (74) rest, and wherein said ink feeder (76) has a recess (88) on its bottom into which a tool can be inserted through the gap (84) of the nib (74) in order to install or remove said nib.

13. A writing instrument according to claim 1, wherein a (90) is attached at the rear end of said writing instrument.

14. A writing instrument according to claim 13, wherein said plaque is attached by means of a snap fastener comprising a stud (92) having an annular groove (94) therearound which is engaged by radially inwardly projecting ridges in a socket opening (96) in the rear end of the writing instrument.

15. A writing instrument according to claim 1, wherein said clip (20) has a lower end which is configured as a clamp body and which is provided with a plurality of gripping teeth (54) pointing inwardly toward the longitudinal axis of said writing instrument.

16. A writing instrument comprising a writing member disposed in a housing wherein said housing includes a top part configured to define a laterally open cavity with axially parallel cavity side walls, said cavity extending from an upper side portion to a top portion of said top part; said top part further being configured to define a clip recess extending axially along a side portion thereof from said cavity toward a bottom portion of said top part;

a movable clip member mounted in said top part comprising an enlarged clip head with axially parallel clip head side walls received in said cavity and an elongated clip portion extending substantially parallel to the axis of said writing instrument;

guide means arranged on said cavity side walls and on said clip head side walls at an acute angle to the axis of said writing instrument for guiding said movable clip member along an oblique path between a retracted position in which said clip portion is received in said clip recess and an extended position in which said clip portion is spaced away from said top part, and an end piece insertable into said laterally open cavity through its lateral opening and secured in said cavity to said top part, said end piece including a stop portion which engages said movable clip member when said clip member is moved toward said extended position to limit the travel of said movable clip member in the direction of said extended position and retain said clip head in said cavity.

17. A writing instrument according to claim 16, wherein said guide means comprise a pair of elongated grooves formed on opposite sides of said clip head and an elongated rib formed on each cavity side wall and received in a respective one of said grooves.

18. A writing instrument according to claim 16, further comprising a compression spring disposed between said stop portion of said end piece and a projection of said clip head for urging said clip member toward said retracted position.

* * * * *